US009376773B2

(12) United States Patent
Wepner et al.

(10) Patent No.: US 9,376,773 B2
(45) Date of Patent: Jun. 28, 2016

(54) OUTDOOR FLOOR COVERING THAT CAN BE DISASSEMBLED

(71) Applicant: Hamberger Industriewerke GmbH, Stephanskirchen (DE)

(72) Inventors: Falko Wepner, Ramerberg (DE); Friedrich-Wilhelm Struve, Rosenheim (DE); Stefan Kuner, Meiningen (DE); Peter Hamberger, Stephanskirchen (DE)

(73) Assignee: Hamberger Industriewerke GmbH, Stephanskirchen (DE)

( * ) Notice: Subject to any disclaimer, the term of this patent is extended or adjusted under 35 U.S.C. 154(b) by 64 days.

(21) Appl. No.: 14/378,859

(22) PCT Filed: Feb. 15, 2013

(86) PCT No.: PCT/EP2013/053075
§ 371 (c)(1),
(2) Date: Aug. 14, 2014

(87) PCT Pub. No.: WO2013/120993
PCT Pub. Date: Aug. 22, 2013

(65) Prior Publication Data

US 2016/0017550 A1 Jan. 21, 2016

(30) Foreign Application Priority Data

| | | |
|---|---|---|
| Feb. 16, 2012 | (DE) | 10 2012 101 241 |
| Mar. 21, 2012 | (DE) | 10 2012 102 385 |
| Jan. 4, 2013 | (DE) | 10 2013 100 051 |

(51) Int. Cl.
*E01C 13/04* (2006.01)
*E01C 9/08* (2006.01)

(Continued)

(52) U.S. Cl.
CPC . *E01C 13/04* (2013.01); *E01C 9/08* (2013.01); *E01C 9/086* (2013.01); *E01C 13/02* (2013.01); *E01C 13/045* (2013.01); *E01C 2201/14* (2013.01)

(58) Field of Classification Search
CPC ..... A63C 19/00; A63C 19/04; A63C 19/06; A63C 19/08; E01C 5/00; E01C 5/001; E01C 5/005; E01C 5/20; E01C 5/226; E01C 2001/16; E01C 13/00; E01C 13/02; E01C 13/04
USPC ..... 472/88–94; 52/177, 539, 582.2
See application file for complete search history.

(56) References Cited

U.S. PATENT DOCUMENTS

| | | | | |
|---|---|---|---|---|
| D618,368 | S | 6/2010 | Jenkins et al. | |
| 7,748,177 | B2 * | 7/2010 | Jenkins | E01C 5/20 15/215 |

(Continued)

FOREIGN PATENT DOCUMENTS

| | | |
|---|---|---|
| DE | 3918240 | 10/1990 |
| DE | 60 2005 000 432 | 10/2007 |

(Continued)

OTHER PUBLICATIONS

DE Search Report, dated Feb. 5, 2013, from the corresponding German application (10 2013 100 057.7).

(Continued)

*Primary Examiner* — Kien Nguyen
(74) *Attorney, Agent, or Firm* — Boyle Fredrickson S.C.

(57) ABSTRACT

What is disclosed is removable outdoor sport flooring consisting of a plurality of floor elements that in turn have a layer of load distribution elements on which a cover layer is applied. The floor elements lie on a damping layer, the load distribution elements, the cover layer and the damping layer being implemented so as to be water-resistant.

11 Claims, 2 Drawing Sheets

(51) Int. Cl.
*E01C 13/02* (2006.01)
*A63C 19/00* (2006.01)

(56) References Cited

U.S. PATENT DOCUMENTS

| | | | | |
|---|---|---|---|---|
| 8,683,769 | B2 * | 4/2014 | Cerny | E01C 5/001 404/36 |
| 2008/0153609 | A1 | 6/2008 | Kotler | |

FOREIGN PATENT DOCUMENTS

| | | |
|---|---|---|
| EP | 1197611 | 12/2005 |
| EP | 2239024 | 10/2010 |
| EP | 2239025 | 10/2010 |
| GM | 7719620 | 11/1977 |
| WO | 2006042221 | 4/2006 |
| WO | 2011090499 | 7/2011 |
| WO | 2011094461 | 8/2011 |

OTHER PUBLICATIONS

International Preliminary Report on Patentability from the PCT application, dated Aug. 19, 2014.

* cited by examiner

Fig. 1
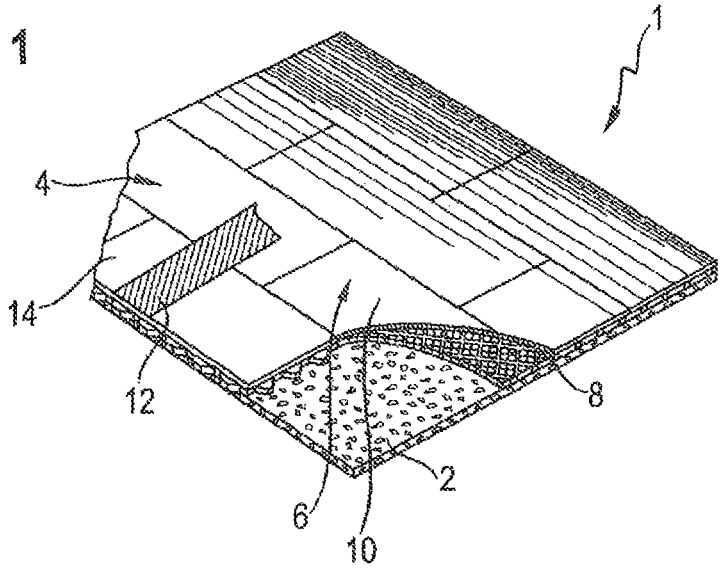
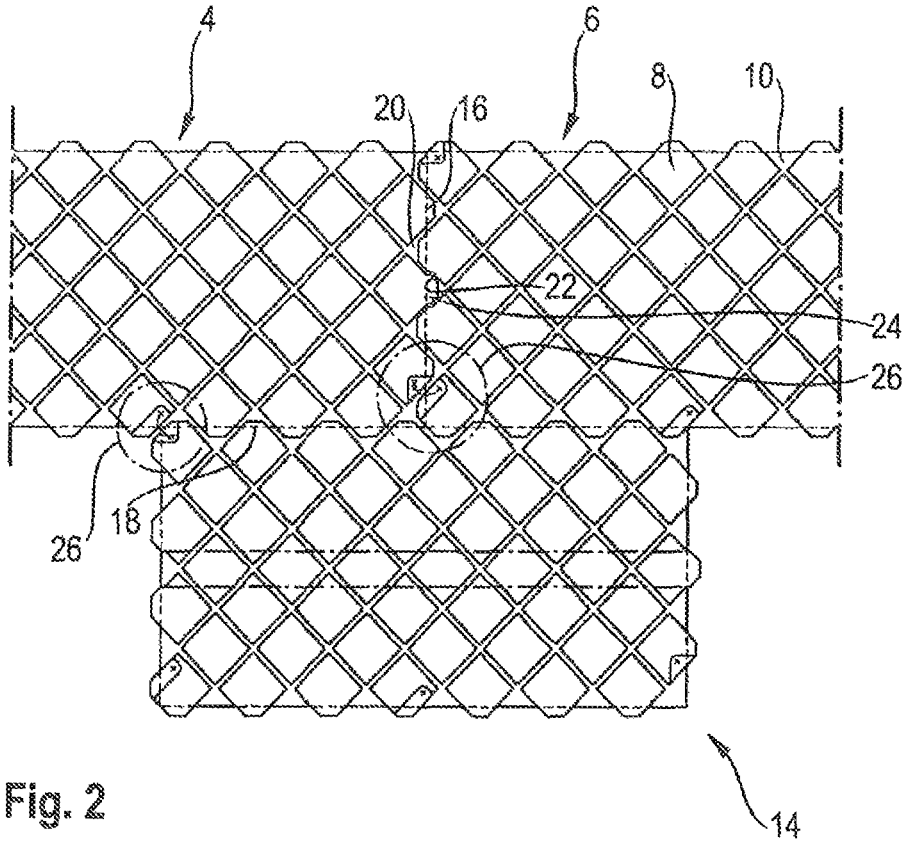
Fig. 2

OUTDOOR FLOOR COVERING THAT CAN BE DISASSEMBLED

BACKGROUND OF THE INVENTION

1. Field of the Invention

The invention relates to removable outdoor flooring, particularly to outdoor sports flooring in accordance with the claims.

2. Description of Related Art

Such outdoor flooring is disclosed, for example, in WO 2011/090499 A1.

The flooring consists of a plurality of floor elements of approximately rectangular floor space on the abutting edges of which fitting parts are formed that interact with corresponding fitting parts of the adjacent floor element in the manner of a locking or centering mechanism. Those fitting parts may be formed integrally on the floor element. Alternatively or additionally, the connection or centering may be done via locking elements which connect adjacent floor elements in a force- or form-fit manner. The floor elements made of synthetic material form a sub-floor on which a cover layer can be laid, which in turn consists of approximately rectangular floor tiles. The floor elements of the sub-floor are made of a material that ensures good shock absorbance and with regard to thermal expansion coefficients is selected so as to withstand strains in outdoor activities. Recycled material may also be used. The material and structure of the cover layer are designed in accordance with the demands of the respective sport, e.g., tennis or basketball.

The disadvantage of such a structure is that the efforts and costs with regard to apparatus and to laying for preparing the flooring are considerable.

WO 2006/042221 A3 and US design patent US D618,368 S show sports flooring formed of multi-layer grid-shaped elements of synthetic material that likewise have locking elements on their abutting edges. Such grid-shaped flooring can only be applied in sports with comparatively low demands. For use in sports with high demands on the flooring, such as, for example, outdoor basketball or outdoor tennis, such flooring is less suited.

WO 2011/094461 shows a similar grid-shaped floor that is implemented using flexible inserts for bracing. This floor basically exhibits the same disadvantages as the afore-described floor.

EP 2 239 024 A2 discloses a shock absorbing flooring that is formed in two layers, i.e. with an upper layer and a lower layer. The upper layer essentially consists of rubber granulate that is preferably made by reprocessing old tires. The lower layer is implemented with a filament cavity body that is provided, for example, as filament random layer. Such materials essentially consist of a polymer material. The lower layer that consists of the filament cavity bodies in turn can be covered by two fiber material layers towards the upper layer and towards the lower layer.

Such flooring is to be installed and removed only with extremely high effort, so that it is rather suited for stationary applications, e.g., playgrounds.

In GM 77 19 620 outdoor flooring is described that consists of a plurality of floor elements implemented with an elastically flexible layer that is applied to a carrier. The elastic layer in turn consists of a material that is gained by reprocessing plastic waste, e.g., old tires.

Also such a floor is provided for stationary installation and is not suited to meet the above-described demands in case of dynamic sports, such as tennis and basketball.

SUMMARY OF THE INVENTION

As opposed thereto, the invention is based on the object of providing removable outdoor flooring that even withstands most unfavorable climatic influences and meets the demands on use in dynamic sports, such as tennis or basketball.

The object is solved by outdoor flooring including the features of claim 1.

Further advantageous features of the invention are dealt with in the sub-claims.

In accordance with the invention, the removable outdoor flooring comprises a plurality of floor elements of approximately rectangular floor space, fitting elements being formed on abutting edges of a floor element that interact with corresponding fitting elements of an adjacent floor element in the manner of a locking or centering mechanism. Each floor element has a multi-layer structure, a layer of one element, e.g. a load distribution element or a plurality of elements/load distribution elements being provided, on which a cover layer is applied. Furthermore, the flooring has a damping layer on which the floor elements are applied. The load distribution layer, the cover layer and the damping layer each are implemented so as to be water-resistant, so that the floor can be used even in unfavorable weather conditions, e.g., rain, and fulfills the requirements imposed.

In accordance with the invention it is preferred that the cover layer is formed of a plate covering the load distribution layer.

The plate and/or the load distribution layer of a floor element may consist of synthetic material, plastic composites (e.g., WPC (Wood Plastic Composites), fiber- or glass fiber-reinforced plastics), mineral-filled plastics, mineral plate materials (inter alia fiber-reinforced flex-ceramics), honeycomb plate structures, and/or wood or wood-based materials that are weatherproof due to treatment (e.g., sealing, impregnation, foliation) or on account of their composition. Thermal parting planes may also be incorporated in those plate structures.

In a particularly preferred solution, the damping layer is configured as a foam layer, which is shrink-wrapped in a waterproof manner or laminated. The particular advantage of such a foam layer consists in that such layer can be delivered and laid, e.g., as roll or plate material, so that there is considerably less effort for creating the lower layer than in the prior art described above. As a foam layer, a material can be used that by itself is not waterproof. The resistance to water is then achieved by waterproof shrink-wrapping or lamination.

PUR composite foam or cross-linked polyolefin foam have turned out to be particularly suited.

In principle, also synthetic material that is produced by reprocessing waste materials, for example, old tires can be used as basic material for the damping layer. Moreover, bubble wrap and caoutchouc materials (e.g. rubber sponge rubber, etc.) are also suited.

In addition to the damping function, the damping layer may additionally adopt a drainage function for removing water. Alternatively, the problems of drainage can be solved by suitable sub-floors or drainage mats.

Suitable surface flooring that is selected according to the demands of the respective sport can be applied to the cover layer preferably formed as a plate. In the ease of tennis, an acrylic layer may be used, for example, which is mixed with friction improving materials, e.g. sand or corundum. In case of a use as sports flooring for basketball, the cover layer may be formed through a suitable film including constituents of e.g. polyethylene, polyolefin, polyvinylchloride, jammer, acrylic, polyester, polyurethane and molten polyurethane, respectively.

The cover layer or the surface flooring may be a decorative film or a decorative coating layer (made of acrylic. PUR or HotMelt, for example). In an embodiment of the invention, the plate is made of PVC or a glass fiber material, whereas the load distribution elements consist of ABS.

In accordance with the invention it is preferred that the cover layer or the surface flooring is provided with field marking sections, so that the entire field marking is formed by the floor elements laid according to a predefined laying pattern without post-processing.

In order to avoid unintentional loosening of the floor elements or occurrence of high spots, the floor elements can be implemented with a locking mechanism through which adjacent floor elements can be locked with each other.

Load distribution elements or fitting elements arranged on the abutting edges can be formed, at least section-wise, of a material that is more resistant to wear than the other load distribution elements. In the cover layer of a floor element, fitting elements can be inserted that mesh with corresponding recesses of the adjacent floor element.

Moreover, thermal parting planes may be incorporated in those plate structures.

These and other features and advantages of the invention will become apparent to those skilled in the art from the following description and the accompanying drawing. It should be understood, however, that the detailed description and specific examples, while indicating a preferred embodiment of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

In the following, a preferred embodiment of the invention is explained in more detail by way of schematic drawing figures of which FIG. 1 shows a perspective view of a removable outdoor sports flooring;

FIG. 2 shows a view onto the sports flooring according to FIG. 1 from below.

DETAILED DESCRIPTION OF THE DRAWINGS

Figure 3:
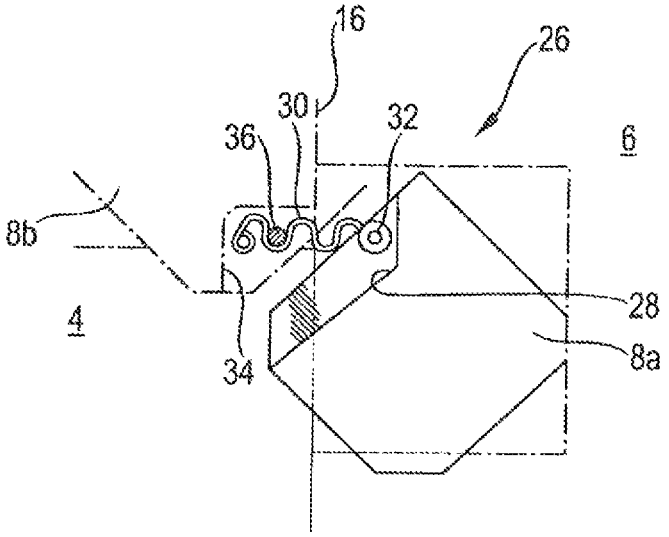
FIG. 3 shows a detail of the bottom view of FIG. 2.

The outdoor sports flooring 1 described in the following is implemented as removable sports flooring and can be laid, for example, in series events such as outdoor basketball tournaments, on almost any level sub-floor. After the tournament, the floor is removed again and transported to the next venue. The sports flooring described in the following, is particularly suited for outdoor basketball in which both teams play for a single basket. This comparatively young sport is getting more and more popular both in the United States and in Europe and quite profitable tournaments organized by diverse organizers already take place. The removable outdoor sports flooring makes it possible to carry out such tournaments in different locations with minimum demands on structural conditions. Basically, all that is required is that a suitable subfloor is made available. Thus, the tournaments may virtually be carried out on any level parking place, the place at most requiring to be equalized by a layer of bitumen.

This correspondingly also holds for outdoor tennis tournaments, as such removable sports floorings make it possible to perform tournaments, training camps or the like far from any tennis stadium.

The floor described in the following is designed so as to fulfill various standards, e.g. DIN standard. V 18032-part 2, April 2001, EN 14904, or FIBA standard, status 2010, in case of basketball. This correspondingly holds for standards applicable for tennis or other sports.

FIG. 1 shows a schematic representation of an embodiment of the removable outdoor sports flooring. The flooring is laid on a sub-floor not depicted in more detail, for example, on a cement screed or a bitumen layer. The flooring 1 basically consists of a damping layer 2 on which a plurality of floor elements 4, 6, 14 are laid. Those floor elements are laid out and joined so as to be firmly on the damping layer 2 and thus also on the sub-floor even at high loads, without a high spot or the like arising.

Each of floor elements 4, 6 basically consists of a plurality of elements that form a load distribution layer, referred to as load distribution elements 8 in the following, which are connected to a cover layer 10. As implied by FIG. 1, a marking 12 can be applied on this cover layer, which marking is completed to form a field or court marking when the floor is laid, this naturally assuming that the individual floor elements 4, 6 are laid according to a predefined laying plan.

Depending on the sport, suitable surface flooring may be applied on the cover layer 10. As was mentioned initially, an acrylic layer known per se may be rolled e.g., onto a sports flooring for tennis, in which particles that improve friction, such as quartz sand or the like, are embedded.

In basketball, film layers are typically applied on the cover layer. Cover layer 10 per se, for example, consists of a plate-shaped waterproof material. The plate and/or the load distribution layer of a floor element may be made of synthetic material, plastic composites (e.g., WPC (Wood Plastic. Composites), fiber- or glass fiber-reinforced plastics), mineral-filled plastics, mineral plate materials (inter aria fiber-reinforced flex-ceramics), honeycomb structures, and/or wood or wood-based materials that are weatherproof due to treatment (e.g., sealing, impregnation, foliation) or on account of their composition. Thermal parting planes for improving thermal insulation may also be incorporated in those plate structures. For improving their optical appearance, the materials can be veneered and then sealed in a waterproof manner.

The damping layer 2 may be formed, for example, from RJR composite foam or from any other elastic foam layer. As such a layer per se is not waterproof, it is suitably shrink-wrapped in a waterproof manner or laminated, so that, on the one hand, the excellent damping characteristics of a per se non-waterproof material can be used and, on the other hand, also permanent water-resistance is ensured. Such damping characteristics cannot be obtained using the sub-layers of the prior art described at the beginning.

Although, in principle it is also possible to use a damping layer made of a per se waterproof material, e.g., recycled old tires, convoluted foams, rubber materials, PU-based synthetic materials, cross-linked polyolefins, or the like, damping often is clearly inferior than in case of the foam layers that are shrink-wrapped in a waterproof manner or laminated, as mentioned above. This can be solved by a suitable geometry of the damping layer, which also can be connected to the cover layer. In certain sports reduced damping may be quite acceptable.

The structure of the load distribution layer is explained by way of FIG. 2 that shows a bottom view onto the sports flooring of FIG. 1, the damping layer 2, however, being omitted. In this drawing, load distribution elements 8 implemented as approximately rectangular small plates can be recognized on which the plate-shaped cover layer 10 is applied. The side edges of the approximately square load distribution elements 8 are set by approximately 45° as opposed to the side edges of the cover layer 10. The connection between the cover layer 10 and the plurality of load distribution elements 8 may be done, for example, by gluing or bracing. FIG. 2 depicts three floor elements 4, 6 and 14, the two floor elements 4, 6 being adjacent to each other along butt joint 16, and the two floor elements 4, 6 and floor element 14 being adjacent to each other along butt joint 18 perpendicular thereto. It is to be recognized in this figure that the load distribution plates 8 of a floor element that are located in the area of the butt joints section-wise immerse, beyond the butt joint, in a recess portion 20 of the respective adjacent floor element, such overlapping being reciprocal. In the area of a butt joint, in this case butt joint 16, a fitting recess 22 is formed on the floor element 6 in which a fitting protrusion 24 of the other floor element 4 fits precisely, so that the two floor elements 4, 6 are positioned centrally relative to one another. Reference number 26 relates to a locking mechanism through which neighboring panels 4, 8 can be braced with each other. The fundamental structure of such locking mechanism and the floor elements is shown in EP 1 197 611 B1 of Applicant, however, the document relates to indoor sports flooring.

FIG. 3 exhibits the basic structure of the locking mechanism 26; from the drawing, two load distribution elements 8*a*, 8*b* adjacent to one another of two adjacent floor elements 4, 6 along butt joint 16 are recognizable, the load distribution elements 8*a*, 8*b*, with their corner areas, section-wise project towards the respective other floor element beyond the butt joint 16. In accordance with FIG. 3, the load distribution element 8*a* is implemented with a bag-shaped recess 28 in which a wavy spring 30 is pivotably mounted about a pivot axis 32. Correspondingly, the other load distribution element 8 likewise has a recess 34 from which a fixing bolt 36 projects, which, in a locking state, is encompassed by a winding of wavy spring 30 in a force- and form-fit manner, the length of the spring being slightly extended in the locking state, i.e. the state depicted in FIG. 3, whereby a force component effective in an abutting direction is exerted on neighboring floor elements 4, 6. Those floor elements thus, on the one hand, are fixed in a force-fit manner via wavy spring 30, and, on the other hand, they are fixed in a form-fit manner via projection 24 and recess 22. In an unlocked state, the wavy spring 30 is swiveled back in the bag-shaped recess 28 and can be swiveled in the likewise bag-shaped recess 34 of the adjoining floor element 4 in a simple manner, using a special tool, when laying the floor, until the fixing bolt 36 is encompassed with preload. As for further explanations with regard to the floor structure reference is made to EP 1 197 611 B1 indicated above for the sake of simplicity.

Preliminary tests have shown that such a floor having a water-resistant cover layer, water-resistant load distribution elements (load distribution layer) and a damping layer not inherently connected therewith, remains playable for a long time even in the most unfavorable weather conditions and maintains its pre-defined damping values as well as the surface quality required for the respective sport. The laying is extremely simple, as the individual floor elements 4, 6 can be locked or unlocked very easily via the locking mechanism 26. Also the laying of the damping layer is very simple since it can be provided as roll material or also as plate-shaped material, the actually non-waterproof material of the damping layer being protected by laminating, shrink-wrapping, or in another manner so as to be waterproof. It is preferred that the damping layer is made comparatively large, so that a damping layer element can be covered by plural floor elements 4, 6.

A further advantage of the outdoor sports flooring consists in that it requires very little storage room, so that e.g., transport between individual venues is possible at low effort and cost.

What is disclosed is removable outdoor sport flooring consisting of a plurality of floor elements that in turn have a layer of load distribution elements on which a cover layer is applied. The floor elements lie on a damping layer, the load distribution elements, the cover layer and the damping layer being implemented so as to be water-resistant.

Although the best mode contemplated by the inventors of carrying out the present invention is disclosed above, practice of the above invention is not limited thereto. It will be manifest that various additions, modifications and rearrangements of the features of the present invention may be made without deviating from the spirit and the scope of the underlying inventive concept.

The invention claimed is:

1. A removable outdoor flooring, in particular outdoor sports flooring, comprising a plurality of floor elements of approximately rectangular floor space, fitting elements being formed on abutting edges of a floor element that interact with corresponding fitting elements of an adjacent floor element in the manner of a locking or centering mechanism, wherein each floor element has a load distribution layer made of an element or a plurality of elements on which a cover layer is applied and which rest on a damping layer, the load distribution elements, the cover layer and the damping layer being implemented so as to be water-resistant.

2. The flooring of claim 1, wherein the cover layer is a plate.

3. The flooring of claim 2, wherein the plate and/or the likewise plate-shaped load distribution layer consist of synthetic material, plastic composites, fiber- or glass fiber-reinforced plastics, mineral-filled plastics, mineral plate materials (inter alia fiber-reinforced flex-ceramics), honeycomb plate structures, and/or wood or wood-based materials that are weatherproof due to treatment (e.g. sealing, impregnation, foliation) or on account of their composition.

4. The flooring of claim 1, wherein the damping layer is a foam layer that is shrink-wrapped in a waterproof manner or laminated.

5. The flooring of claim 4, wherein the damping layer consists of PUR composite foam or cross-linked polyolefin foam.

6. The flooring of claim 1, wherein the damping layer consists of recycled synthetic material, preferably old tires, bubble wrap, PU-based synthetic materials or caoutchouc materials.

7. The flooring of claim 1, wherein a surface flooring is applied on the cover layer.

8. The flooring of claim 7, wherein the surface flooring is a decorative film and/or a coating layer.

9. The flooring of claim 1, wherein a field or court marking is applied on the cover layer.

10. The flooring of claim 1, including a locking mechanism for detachably locking two adjacent floor elements.

11. The flooring of claim 1, wherein the damping layer has a drainage function for removing water.

* * * * *